United States Patent [19]

Dengler et al.

[11] 4,302,123

[45] Nov. 24, 1981

[54] CLASP ELEMENT

[75] Inventors: Wolfgang Dengler, Thorwaldsenstrasse 23, Münich 2, Fed. Rep. of Germany, 8000; Hans Vetter, Stuttgart, Fed. Rep. of Germany

[73] Assignee: Wolfgang Dengler, Munich, Fed. Rep. of Germany

[21] Appl. No.: 96,816

[22] Filed: Nov. 23, 1979

[30] Foreign Application Priority Data

Nov. 24, 1978 [DE] Fed. Rep. of Germany ..... 2850942

[51] Int. Cl.[3] ..... B42F 13/12; B42F 13/36

[52] U.S. Cl. ..... 402/80 R; 402/17; 402/64

[58] Field of Search ..... 402/13, 17, 64, 65, 402/80 P, 80 R

[56] References Cited

U.S. PATENT DOCUMENTS 3,776,648 12/1973 Price ..... 402/17

3,957,321 5/1976 Rose ..... 402/17 X

FOREIGN PATENT DOCUMENTS 2089324 12/1971 France ..... 402/17

*Primary Examiner*—Paul A. Bell

*Assistant Examiner*—John S. Brown

*Attorney, Agent, or Firm*—Gordon W. Hueschen

[57] ABSTRACT

Clasp element consisting of a U-shaped retaining bar with beaded edges and connected with a file cover, of two slides, which are mounted slidably to and fro between a suspension setting and a stacking setting, are clippable from above onto the retaining bar and which are bringable into engagement by side webs with the beaded edges of the retaining bar, with hookshaped end sections and longitudinal webs which engage into the U-profile of the retaining bar for the formation of a central groove for flexible filing spikes, the ends of which are pluggable through openings of the retaining bar and in bent-over state lockable by the slides, wherein tongues forming a catching space for the filing spike are provided at the end of the slide pointing towards the middle of the bar, an end strip covering the cross-sectional profile of the retaining bar is provided at the end of the slide lying opposite the tongues, and wherein the central groove displays a ramp in the region of the catching space.

17 Claims, 21 Drawing Figures

CLASP ELEMENT

FIELD OF INVENTION AND PRIOR ART

The invention relates to a clasp element consisting of a U-shaped retaining bar with beaded edges and connected with a file cover, of two slides, which are mounted slidably to and fro between a filing setting and a stacking setting, are clippable from above onto the retaining bar and which are bringable into engagement by side webs with the beaded edges of the retaining bar, with hookshaped end sections and longitudinal webs which engage into the U-profile of the retaining bar for the formation of a central groove for flexible filing spikes, the ends of which are pluggable through openings of the retaining bar and in bent-over state lockable by the slides.

Retaining or clasp elements of that kind find increasing use in data processing, in which great quantities of printed, folded paper webs arise, which are laterally provided with perforations for the transport in the printer of the data processing system. For the keeping and filing of the im part quite voluminous paper webs or print-outs, tapes or flexible filing spikes are drawn through the holes originally serving the transport of the paper web, are then plugged through a bar provided with a file cover and locked by means of a slide movable on the bar.

A known clasp element (DE-OS No. 2,558,578) comprises a retaining bar connected with a file cover and with slides which are arranged displaceably thereon and which for the release of the filing spikes are pushed inwardly along the retaining bar. Abutments, which are bringable into engagement with the slides and which shall prevent an unintended removal of the slides from the retaining bar, are provided at the end of the bar.

For the connecting of a clasp element of that kind with the initially named paper webs of a data processing system, a filing spike is plugged through the perforations of the paper web at both sides thereof. Thereupon, the filing spikes on the upper and lower side of the paper web stack are plugged through the holes provided in the retaining bars of a clasp element arranged above and below the paper web stack.

For the locking of the clasp elements with the paper web stack, it is now necessary by the one hand each time to bend over and hold down the filing spikes and by the other hand to push the respective slide over the filing spike in the direction of the end of the bar. The sharp edges of the bar ends in that case lie free so that there is the risk of an injury of the operating person.

This locking process is very awkward, since it cannot be carried out simultaneously. Beyond that, the slides are during the locking guided against the kinking direction of the filing elements, which can lead to a loosening of the attained stressing of filing spike, retaining bar and paper web stack and thereby to an unsteadiness in the region of the file spine and to the tearing-apart of the individual sheets.

Furthermore, a simultaneous unlocking of the slides is not possible when the spacing between both the ends of the bent-over filing elements amounts to less than the length of two slides. This is for example the case when the paper web stack to be filed displays only a small height.

OBJECTS OF THE INVENTION

It is an object of the invention to provide a clasp element of the initially named kind in such a manner that a simultaneous locking of the retaining spikes in their kinking direction, i.e. towards the middle of the bar, and a simultaneous unlocking of the retaining spikes towards the bar end is made possible, for which the slides are so constructed that they are usable for both bar ends and easily clippable onto the bars and wherein a risk of injury to the operating person is avoided.

Further objeare to avoid the disadvantages of the prior art and to obtain such advantages as will appear as the description proceeds.

BRIEF DESCRIPTION OF THE INVENTION

These objects are accomplished by a clasp element for a loose-leaf binder which comprises a U-shaped retaining bar with beaded edges adapted to be connected with a file cover, a slide which engages said beaded edges and is mounted to slide to and fro thereon between a filing setting and a stacking setting and has longitudinal webs which depend into the U-profile of the retaining bar to form a central groove for a flexible filing spike the end of which is adapted to be inserted through an opening in the retaining bar and to be bent over on movement of the slide from stacking setting toward filing setting, and is particularly directed to the improvement which comprises tongues disposed over said beaded edges and spaced to form a catching space for the filing spike at the inner end of the slide, an end strip covering the cross-sectional profile of the retaining bar at the outer end of the slide, and a ramp in the central groove sloping downwardly from the catching space and away therefrom. When the slide is moved from the stacking setting toward the binding or filing setting, the filing spike is first engaged by the inner end of the ramp and then, on further inward movement of the slide, it is bent over and pressed down by the ramp.

In further advantageous refinement of the clasp element, there is provided stop means comprising a blocking element on the slide complementry with a locking element on the retaining bar, the locking and blocking elements cooperating to limit the movement of said slide relative to the retaining bar. These elements may take different forms and are intended to hold the slide in the filing setting or in an intermediate suspension setting and to prevent the slide from inadvertently being taken off of the retaining bar when it is pulled out to the stacking setting.

In a preferred form of the invention, the locking elements comprise abutment ramps, the outer ends of which comprise a ramp surface which slopes downwardly and outwardly and the inner ends of which comprise vertical abutment surfaces, and the blocking elements comprise cams operative to ride up over the abutment ramps which is facilitated by the ramp surface and deterred by the vertical abutment surfaces.

Advantageously, a second vertical abutment surface is disposed at the inner end of the slides and is adapted to engage the first vertical abutment surface when the slide is fully pulled out. Preferably, the cams comprise trapping cams which are disposed close enough to the second vertical abutment surfaces to trap the abutment ramps between them and the second vertical abutment surfaces when the slide is fully pulled out. Additional cams can be disposed between the trapping cams and the abutment ramps so as to impede the outward movement of the slide beyond the suspension setting.

The several settings of the slide are determined or fixed by means of the abutment at the tongue side which limits the outward movement of the slide and the end strip which limits the inward movement of the slide in conjunction with the abutment ramps and further settings of the slide between both the end settings, namely the filing setting and the suspension setting of the slide, are determined or fixed by means of the cams, wherein the filing setting can co-incide with the one end setting of the slide.

Further advantageous refinements include modifications which will be described hereinafter with reference to FIGS. 8 through 14.

Thus, according to FIG. 8, a clasp element is created, which demands low manufacturing tolerance, in that case however displays a good flexibility which assures a secure locking of the clasp element. Through the spring elements formed in the slide by simple cutting into the upper part of the bar, a secure locking of the slide is assured even after the occurrence of wear phenomena.

By the embodiment according to FIG. 9, a clasp element is created which requires low manufacturing tolerances, since use is made of the spring effect of the edge webs. This embodiment distinguishes itself in advantageous manner by a low overall height, whereby the file produced by means of the clasp element displays lower dimensions.

Created by the embodiments according to FIGS. 10 and 11 is a further clasp element requiring low manufacturing tolerances, wherein the spring effect of the middle webs of the slide is utilized. This clasp element, too, distinguishes itself in advantageous manner by a low overall height. Furthermore, it is possible so to increase or selectably to set the flexibility of the element, since the middle webs of the slide by contrast to the edge webs, which hold the slide against the bar, are relatively unloaded.

By the embodiments according to FIGS. 12 and 13, a clasp element is likewise created, which requires low manufacturing tolerances in that the spring effect of the upper part of the bar is utilized. This clasp element distinguishes itself particularly through a simple manufacture, since the grooves in the end-sided outside surfaces of the middle webs or in the groove bottom of the middle groove are relatively simple to produce. Furthermore, the low overall height of the clasp element is advantageous.

Created by the embodiment according to FIG. 14 is a clasp element, in which the flexible filing spikes serve as locking elements and the retaining bar thus requires no processing. The filing spike is taken into engagement through the formation of special webs extending towards the middle of the slide, whereby the webs are pressed outwardly towards the edge parts of the bar and thus lock the slide.

It is furthermore provided that the middle groove displays a lower height than the longitudinal grooves and a reinforcing strip is arranged in the region of the catching space edge. Hereby, a secure clamping of slide and filing spike and the reliability of the slide even with frequent unlocking is assured, since the reinforcing strip counter-acts a bending-open of the tongues and thereby the jumping-off of the slide from the retaining bar.

In further advantageous refinement, the middle webs are formed in continuation of the catching space as filing spike guide elements, whereby an arrangement of the filing spike always aligned parallel to the bar is assured and the folding-over of the lid is not obstructed by a spike lying obliquely.

BRIEF DESCRIPTION OF THE DRAWINGS

Examples of embodiment of the invention are illustrated in the drawing and more closely described in the following. There show.

Figure 1:
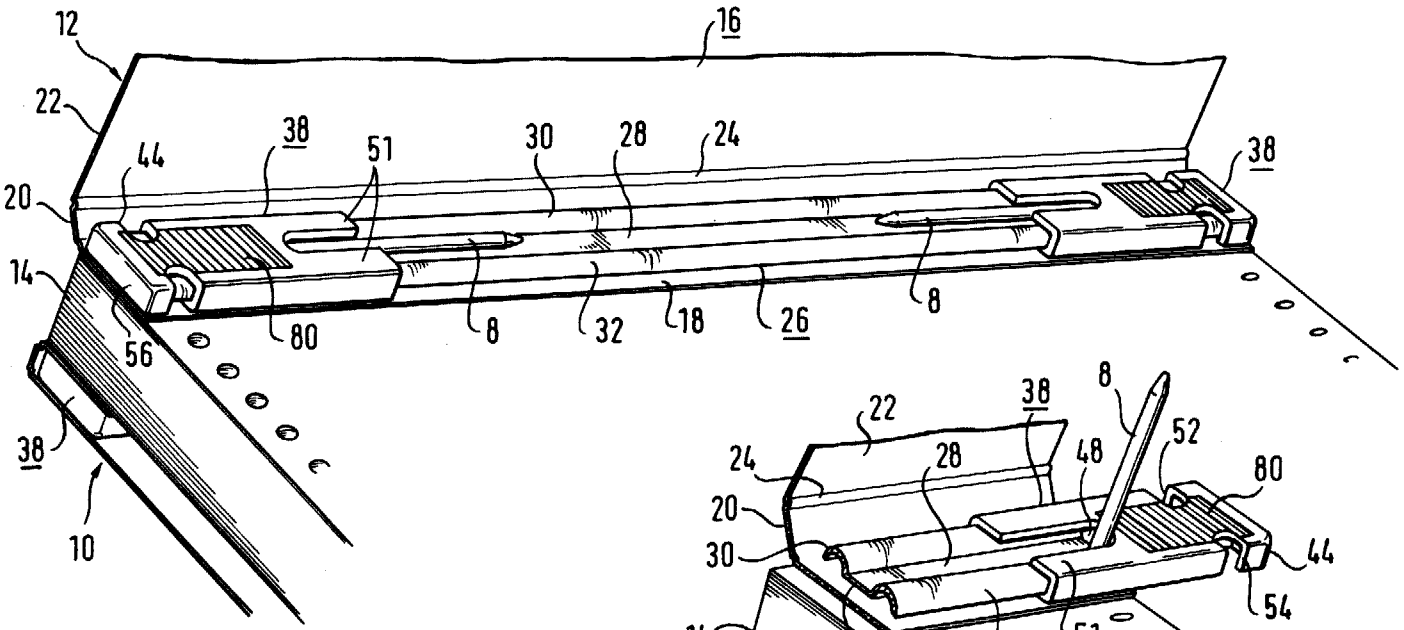
FIG. 1: a perspective view of two clasp elements arranged above and below a paper web stack.

The clasp elements 10 and 12 shown in FIG. 1 are for the formation of a file connected with a paper sheet stack 14 of a data processing system. Both the clasp elements 10 and 12 are identical so that only one of the clasp elements 10 and 12 is described in the following.

The clasp element 12 consists of a cover 16 of cardboard or a suitable synthetic material, which comprises a section 18 for connection with a retaining bar 26, a back section 20 and a cover section 22. Formed between the individual sections are weakened or folding lines 24 which facilitate the folding-over of the cover 16 for the formation of the file.

Figure 5:
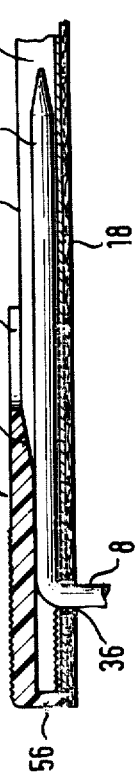
FIG. 5: a sectional view, along the line V—V in FIG. 4, of the slide arranged on the retaining bar.
Figure 6:
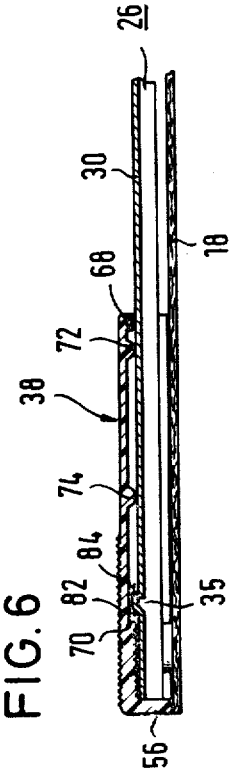
FIG. 6: a sectional view, along the line VI—VI in FIG. 4, of the slide arranged on the retaining bar.

The retaining bar 26 has a U-shaped profile with a planar middle part 28 and two beaded edge parts 30 and 32. The middle part 28 is connected with the section 18 of the cover 16 by means of rivets or other suitable connecting means. The beaded edge parts 30 and 32 serve as guide elements and each end above the middle part 28 so that a slide 38 arranged on the retaining bar 26 can engage by its edge webs 40 and 42 below the edge parts 30 and 32. The retaining bar 26 at its end regions displays holes 36 for plugging-through of the filing spikes 8 (see FIG. 5). The retaining bar consisting of a sheet metal plate can likewise be produced from any other material which displays the suitable strength.

Figure 2:
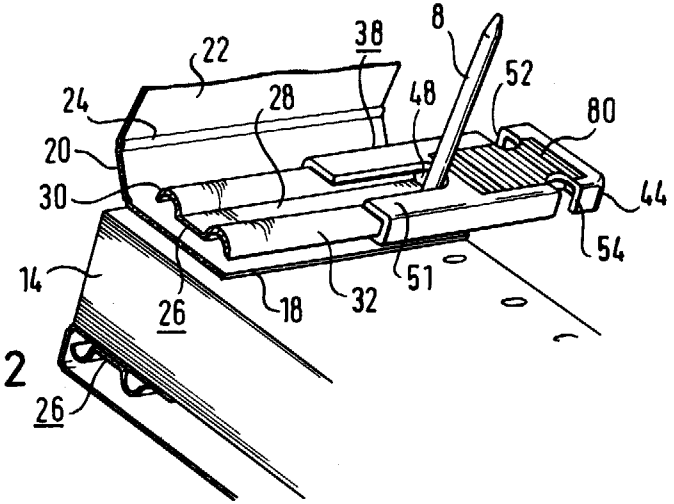
FIG. 2: a perspective detail view of the clasp element, in which the slide is disposed in the filing setting.

The slide 38 is locatable by means of devices described further below on the retaining bar 26 in a filing setting, in which it is pushed completely onto the retaining bar 26, a suspension setting, in which the hookshaped end section 44 protrudes from the retaining bar 26, and a stacking setting where the clasp element is seated on the stack of sheets with a filing spike 8 projecting upwardly therethrough, as seen in FIG. 2.

Figure 3:
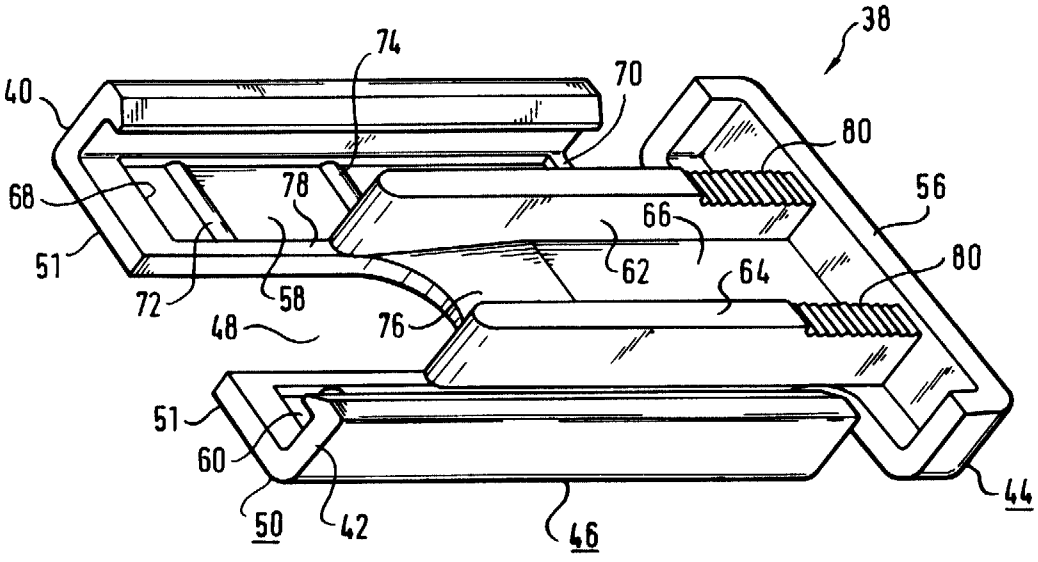
FIG. 3: a perspective view of the slide from below.
Figure 7:
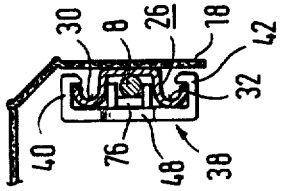
FIG. 7: a sectional view, along the line VII—VII in FIG. 4, of the slide arranged on the retaining bar.
Figure 4:
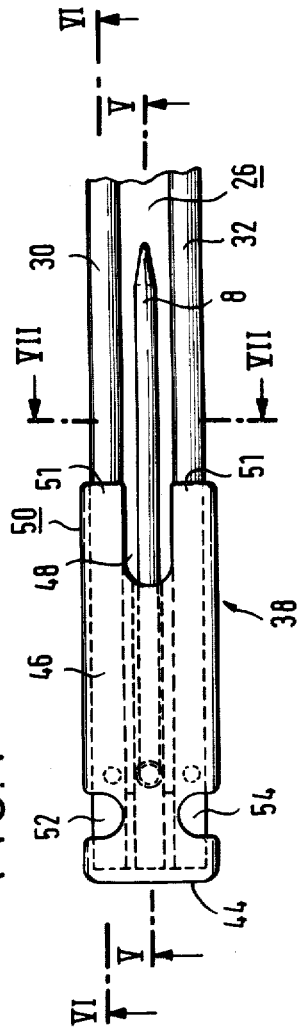
FIG. 4: a plan view of the slide arranged on the retaining bar in locking setting.

The slide, shown in FIG. 3, for the clasp element consists of a main part 46, a hookshaped end section 44 and a forward section 50 forming a catching space 48 for the filing spike 8. The catching space is bounded by two tongues 51 and the main part 46 in such a manner that a U-shaped recess is formed.

The slide comprises two edge webs 40 and 42, which extend from the forward section 50 up to the hookshaped end section, display recesses for the formation of the hooks 52 and 54 and are beaded in the region from the forward section 50 up to the end of the main part 46. The edge web regions in the hookshaped end section 40 are not beaded and connected by means of an end strip 56 which displays substantially the same height as the edge webs 40 and 42. The beaded parts of the edge webs 40 and 42 come into engagement with the beaded edge parts 30 and 32 of the retaining bar 26 when the slide 38 is arranged on the retaining bar 26.

Two longitudinal grooves 58 and 60, which are substantially rectangular in section and which extend from the forward section 50 up to the end of the main part 46, are each formed at the underside of the slide 38 adjoining the edge webs 40 and 42. The longitudinal grooves 58 and 60 are bounded on the side lying opposite the edge webs 40 and 42 each time by two middle webs 62 and 64 which extend from the end of the catching space 48 up to the end strip 56 and between them form a middle groove 66.

The grooves 58 and 60 at their respective ends display steps which are formed once as abutment 68 and once as step 70 for bounding the grooves. Cams 72 and 74 are arranged between the steps. The abutment 68 at the forward end of the groove 58 and 60 serves to limit the setting of the slide 68 in its pulled-out setting. In the setting pushed onto the bar, the end strip 56 serves as limitation of the slide and simultaneously as cover of the sharp end edge. Arranged in about the middle of the main part 46 are the cams 74, which have a spacing from the side of the main part 46 adjoining the hookshaped end section which is somewhat greater than the spacing of the abutment ramps 35 from the respective end of the retaining bar 26. The second cam 72 is arranged at such a spacing from the abutment 68 that the abutment ramp 35 can notch in between abutment 68 and the cam 72. The slide can be located on the bar in three settings by the abutment 68, the end strip 56 and the cams 72 and 74, respectively, namely in the fully pushed-in or filing setting, in the setting pulled out up to the cam 74 or suspension setting and the fully pulled-out or stacking setting, in which the abutment ramps 35 get between the cam 72 and abutment 68 and the hole 36 formed in the bar is aligned with the rear region of the catching space 48 (see FIG. 2). In the last setting, a filing spike 8 can be plugged through the bar.

Refinements of the locking of the slide on the bar are illustrated in the FIGS. 8 to 14.

Figure 8A:
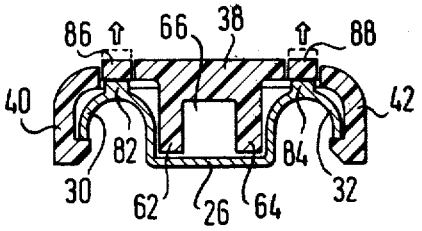
FIG. 8A and 8B: a sectional view of an embodiment of the clasp element in the suspension setting and in the end abutment setting, respectively.
Figure 8B:
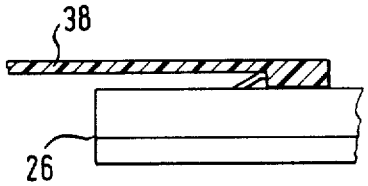

Shown in FIG. 8*a* is a slide which displays spring elements 86 and 88 formed in its upper part. The spring elements can be produced by simple cutting into the upper part, whereby a bridge or a tongue is developed. To lock the slide on the bar, these spring elements 86 and 88 come into engagement with cams 82 and 84 formed on the edge parts of the retaining bar 26. By reason of their elasticity, the spring elements are bent upwardly whereby the resistance of the cams will be surmounted. A formation, corresponding to this embodiment, of the end abutment of the slide is of known mode of construction and illustrated in FIG. 8B. The slide displays an abutment which comes into engagement with the cams 82 and 84.

Figure 9A:
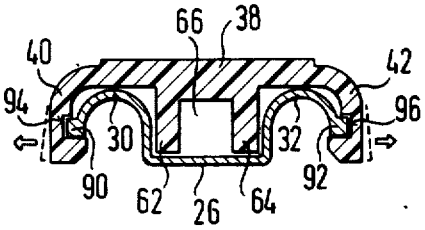
FIG. 9A and 9B: sectional view of a further embodiment of the clasp element in the suspension setting and in the end abutment setting, respectively.
Figure 9B:
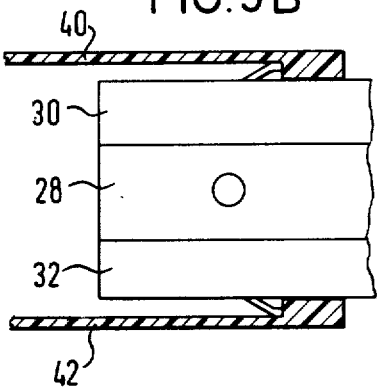

In the example of embodiment illustrated in FIG. 9, the retaining bar is provided at the outside edges of the edge parts with cams 90 and 92 which come into engagement with grooves 94 and 96 formed in the edge webs of the slide, whereby the edge webs of the slide are slightly deformed outwardly. In the end setting, the cams come into engagement in known manner with steps formed at the slide (see FIG. 9B).

Figure 10A:
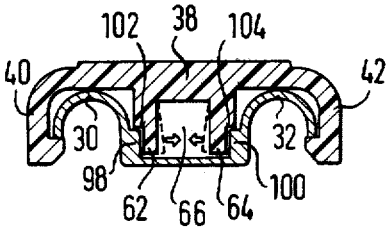
FIG. 10A and 10B: a sectional view of another embodiment of the clasp element in the suspension setting and in the end abutment setting, respectively.
Figure 10B:
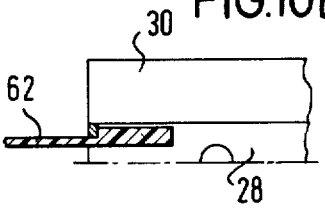

In the slide illustrated in FIG. 10, webs 98 and 100 are formed at the inside surfaces of the edge parts of the bar and come into engagement with grooves 102 and 104, which are formed on the outsides of the middle webs 62 and 64 of the slide 38. The grooves can display projections for suitable locking, whereby the webs are bent towards the middle of the slide when the webs stand in engagement with the grooves, whereby the locking of the slide is effected. The end setting of the slide 38 is determined by a suitable abutment at the end of the grooves formed in the middle webs (see FIG. 10B).

Figure 11A:
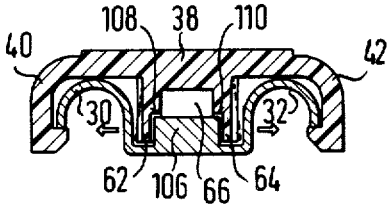
FIG. 11A and 11B: a sectional view of a further embodiment of the clasp element in the suspension setting and in the end abutment setting, respectively.
Figure 11B:
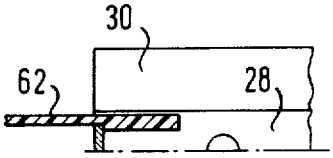

FIG. 11 shows a further possible refinement of the locking of the slide 38 on the retaining bar 26. In this embodiment, a web 106, which comes into engagement with grooves formed on the insides of the middle webs 62 and 64, is provided in the middle part of the retaining bar 26. The grooves can likewise be provided with projections, whereby the middle webs 62 and 64 are pressed outwardly and lock the slide when they stand in engagement with the web 106. In this example of embodiment, the locking of the slide on the retaining bar is additionally reinforced by the engagement of the outside surfaces of the middle webs with the edge parts of the retaining bar. The end setting of the slide is determined by the formation of a suitable end abutment in the grooves 108 and 110 (see FIG. 11B).

Figure 12A:
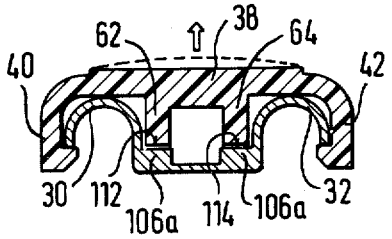
FIG. 12A and 12B: a sectional view of another embodiment of the clasp element in the suspension setting and in the end abutment setting, respectively.
Figure 12B:
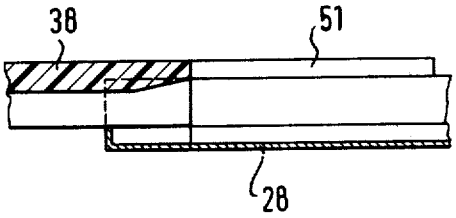

In the example of embodiment illustrated in FIG. 12, webs 106*a*, which come into engagement with the bottom faces 112 and 114 of the middle webs 62 and 64 of the slide 38, are formed on the middle part of the retaining bar 26 in each of the edge regions. Suitable end abutments at the end of the middle grooves 66 determine the end setting of the slide (see FIG. 12B).

Figure 13A:
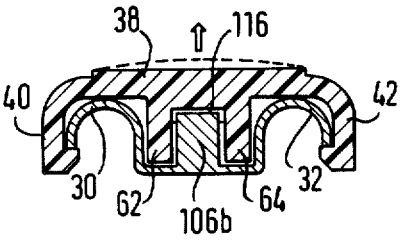
FIG. 13A and 13B: a sectional view of a further embodiment of the clasp element in the suspension setting and in the end abutment setting, respectively.
Figure 13B:
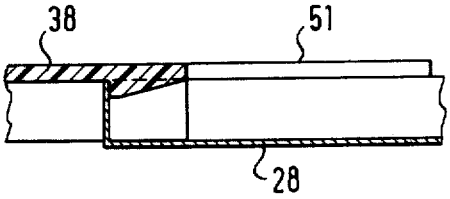

In the embodiment of the slide illustrated in FIG. 13, one web 106*b*, which extends up from the middle part of the retaining bar 28, comes into engagement with a groove 116 formed in the bottom of the middle groove 66 in order to lock the slide. The manner of effecting this locking corresponds substantially to that of the embodiments illustrated in the FIGS. 11 and 12. The end setting of the slide is again determined by an abutment formed at the end of the groove 116.

Figure 14A:
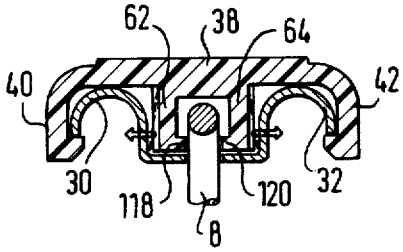
FIG. 14A and 14B: a sectional view of another embodiment of the clasp element in the suspension setting and in the end abutment setting, respectively.
Figure 14B:
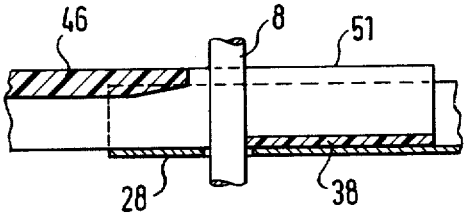

Finally, FIG. 14 shows an embodiment of the locking, in which the retaining bar can remain substantially unchanged. The middle webs of the slide are in this example of embodiment provided at each of their sides facing the middle part of the bar with webs 118 and 120, which extend towards the middle of the slide and which are bringable into engagement with the retaining spike 8 of the clasp element. Due to the shape of the webs 118 and 120, the middle webs are pressed towards the edge parts of the bar during engagement with the retaining spike, whereby the slide is locked. The end setting of the slide can be determined by formation of a transverse web (see FIG. 14B).

The middle groove 66 formed between the two middle webs 62 and 64 lies higher, seen from the underside of the slide 38, than the longitudinal grooves 58 and 60 and has a rectangular cross-section. It extends at the side of the main part 46 adjoining the rear side of the U-shaped catching space 48 up to the end strip 56. At its region adjoining the U-shaped catching space 48, it displays a ramp 76 which drops from the higher level of the middle groove 66 to the height of the longitudinal grooves 58 and 60.

A reinforcing strip 78 is provided around the catching space 48 with the exception of the ramp region. For better manipulation, the slide 38 displays grip knurlings on the upper side as well as also on the lower side in the region of the middle webs 62 and 64 adjoining the end strip 56.

For the production of a file, two filing spikes 8 are plugged through perforations of a paper sheet stack 14 and the holes 36 of the retaining bars 26 of one or two clasp elements.

If the filing spikes are now to be locked, then the slides 38 are moved inwardly on the retaining bars 26. In that case, they seize the filing spikes 8 by means of the catching space 48 formed by the tongues 51 and kink the filing spikes 8 over above the holes 36, whereby the filing spikes get into the middle groove 66 of the slide. In that case, the middle webs 62 and 64 serve as guide for the filing spike so that the filing spike is always arranged parallel to the retaining bar 26 and can impede the folding-over of the cover. The bending-over of the filing spikes 8 is facilitated by the ramp 76 at the underside of the slide 38. Shortly before the filing spikes 8 are seized and kinked over by the slide 38, pressure can be exerted on the slide 38 and thereby onto the retaining bar 26 and the paper sheet stack 14, whereby an optimum compression and tightening of filing spikes 8, retaining bars 26 and paper sheet stack 14 is assured.

To unlock the filing spikes 8, the slides 38 are moved outwardly on the bars. When the main part 46 of the slides frees the filing spikes 8, then the tongues 51 remain on the retaining bar 26. A further outward movement is effectively prevented by the abutments 68 or the corresponding abutments in the embodiments according to FIGS. 8 to 14 in engagement with the abutment ramp 35 or the corresponding cams of webs according to the embodiments of FIGS. 8 to 14. The clasp element 12 can now be taken off with the slides 38 pushed out and script stock can be filed on anew or be removed. The slides 38 are during this operation protected against an unintended pushing-in by the notching-in of the abutment ramp 35 between the abutment 68 and the cam 72 or by the locking according to the embodiments of FIGS. 8 to 14.

We claim:

1. In a clasp element for a loose-leaf binder which comprises a U-shaped retaining bar with beaded edges aadapted to be connected with a file cover, a slide which engages said beaded edges and is mounted to slide to and fro thereon between a filing setting and a stacking setting and has longitudinal webs which depend into the U-profile of the retaining bar to form a central groove for a flexible filing spike the end of which is adapted to be inserted through an opening in the retaining bar and to be bent over on movement of the slide, from stacking setting toward filing setting, the improvement which comprises; tongues (51) dispersed over said beaded edges and spaced to form a catching space (48) for the filing spike (8) at the inner end of the slide (38), an end strip (56) covering the cross-sectional profile of the retaining bar (26) at the outer end of the slide (38) and, a ramp (76) in said central groove 66 sloping downwardly from the catching space (48) and away therefrom, whereby, on movement of said slide, said filing spike is engaged by the inner end of said ramp and then, on further inward movement of said slide, it is bent over and pressed down by said ramp.

2. Clasp element aaccording to claim 1, which further comprises stop means comprising a blocking element on said slide complementary with a locking element on said retaining bar, said locking and blocking elements cooperating to limit the movement of said slide relative to the retaining bar (26).

3. Clasp element according to claim 2, in which the locking elements are formed as cams (82, 84) shaped out on the spines of the beaded edge parts (30, 32) of the retaining bar (26) and the blocking elements are formed as spring elements (86, 88) which extend in longitudinal direction of the tongues (51) and are bringable into locking engagement with the cams (82, 84).

4. Clasp element according to claim 2, in which the locking elements are formed as cams (90, 92) shaped out at the outer side edges of the beaded edge parts (30, 32) of the retaining bar (26) and the blocking elements are formed as grooves (94, 96) formed in the inside surfaces of the edge webs (40, 42).

5. Clasp element according to claim 2, in which the locking elements are formed as cams (98, 100) shaped out at the inner side of the beaded edge parts (30, 32) of the retaining bar (26) and the blocking elements are formed as grooves (102, 104) formed in the outside of the middle webs (62, 64).

6. Clasp element according to claim 2, in which the locking elements are formed as vertical webs (106) extending on the middle part (28) of the retaining bar (26) partially obliquely across the width of the middle part and the blocking elements are formed as grooves (108, 110) shaped out in the lateral inside surfaces of the middle webs (62, 64).

7. Clasp element according to claim 2, in which the locking elements are formed as vertical webs (**106*a*) extending on the middle part (28) of the retaining bar (26) partially obliquely across the width of the middle part and the blocking elements are the bottom faces (112, 114) of the middle webs (62, 64**).

8. Clasp element according to claim 2, in which the locking elements are formed as vertical webs (**106*a*) extending on the middle part (28) of the retaining bar (26) partially obliquely across the width of the middle part and the blocking elements are formed as a groove shaped out in the groove bottom of the middle groove (66**).

9. Clasp element according to claim 2, in which the blocking elements are constructed as webs (118, 120) which extend at right angles from the middle webs (62, 64) towards the middle of the slide and which come into engagement with the filing spikes (8) extending through the middle groove (66).

10. Clasp element according to claim 1, in which the middle groove (66) displays a lower height than the longitudinal grooves (58, 60).

11. Clasp element according to claim 1, in which the middle webs (62, 64) are in continuation of the catching space (48) constructed as guide elements for the filing spike (8).

12. Clasp element according to claim 1, in which a stiffening strip (78) is arranged in the region of the edge of the catching space.

13. Clasp element according to claim 1, in which grip-kurlings (80) are provided on the main part (46) of the slide (38) and in the end region of the middle webs (62, 64).

14. Clasp element according to claim 2, in which said locking element comprises an abutment ramp (35), the outer end of which comprises a ramp surface which slopes downwardly and outwardly and the inner end of which comprises a vertical abutment surface, and in which said blocking element comprises cam means operative to ride up over said abutment ramp, said ramp surface facilitating this and said vertical abutment surface deterring it.

15. Clasp element according to claim 14, in which a second vertical abutment surface is disposed at the inner end of said slide and is adapted to engage the first vertical abutment surface when said slide is fully pulled out.

16. Clasp element according to claim 15, in which said cam means comprises a trapping cam disposed close enough to said second vertical abutment surface to trap said abutment ramp between it and said second vertical abutment when said slide is fully pulled out.

17. Clasp element according to claim 15, in which said cam means comprises an intermediate cam disposed between said trapping cam and said abutment ramp when said slide is fully pushed in.

* * * * *